US011331676B2

(12) United States Patent
Yoon et al.

(10) Patent No.: US 11,331,676 B2
(45) Date of Patent: May 17, 2022

(54) CLEANING AND DEWATERING FINE COAL

(71) Applicant: Virginia Tech Intellectual Properties, Inc., Blacksburg, VA (US)

(72) Inventors: Roe-Hoan Yoon, Blacksburg, VA (US); Mert Kerem Eraydin, Blacksburg, VA (US)

(73) Assignee: VIRGINIA TECH INTELLECTUAL PROPERTIES, INC., Blacksburg, VA (US)

( * ) Notice: Subject to any disclaimer, the term of this patent is extended or adjusted under 35 U.S.C. 154(b) by 0 days.

(21) Appl. No.: 16/788,617

(22) Filed: Feb. 12, 2020

(65) Prior Publication Data

US 2020/0179941 A1 Jun. 11, 2020

Related U.S. Application Data

(62) Division of application No. 15/786,079, filed on Oct. 17, 2017, now Pat. No. 10,562,038, which is a (Continued)

(51) Int. Cl.
*C10L 9/10* (2006.01)
*B03B 9/00* (2006.01)
(Continued)

(52) U.S. Cl.
CPC ..... *B03B 9/005* (2013.01); *B03B 1/04* (2013.01); *C10L 5/366* (2013.01); *C10L 9/10* (2013.01)

(58) Field of Classification Search
CPC . B03B 1/04; B03B 9/005; C10L 5/366; C10L 9/10
See application file for complete search history.

(56) References Cited

U.S. PATENT DOCUMENTS 4,169,714 A * 10/1979 Calvert ..... B03C 3/017 95/62
4,209,301 A 6/1980 Nicol et al.
(Continued)

FOREIGN PATENT DOCUMENTS

CA 1198704 12/1985
CL 47956 10/2011
(Continued)

OTHER PUBLICATIONS

Smith, K., "Cleaning and Dewatering Fine Coal Using Hydrophobic Displacement", May 23, 2008; Virginia Polytechnic Institute and State University [retrieved on Oct. 7, 2016].
(Continued)

*Primary Examiner* — Ellen M McAvoy
*Assistant Examiner* — Chantel L Graham
(74) *Attorney, Agent, or Firm* — Grossman, Tucker, Perrault & Pfleger, PLLC

(57) ABSTRACT

Fine coal is cleaned of its mineral matter impurities and dewatered by mixing the aqueous slurry containing both with a hydrophobic liquid, subjecting the mixture to a phase separation. The resulting hydrophobic liquid phase contains coal particles free of surface moisture and droplets of water stabilized by coal particles, while the aqueous phase contains the mineral matter. By separating the entrained water droplets from the coal particles mechanically, a clean coal product of substantially reduced mineral matter and moisture contents is obtained. The spent hydrophobic liquid is separated from the clean coal product and recycled. The process can also be used to separate one type of hydrophilic particles from another by selectively hydrophobizing one.

11 Claims, 4 Drawing Sheets

Related U.S. Application Data division of application No. 13/576,067, filed as application No. PCT/US2011/023161 on Jan. 31, 2011, now Pat. No. 9,789,492.

(60) Provisional application No. 61/300,270, filed on Feb. 1, 2010.

(51) Int. Cl.
*C10L 5/36* (2006.01)
*B03B 1/04* (2006.01)

(56) References Cited

U.S. PATENT DOCUMENTS

| | | | | |
|---|---|---|---|---|
| 4,244,699 | A | 1/1981 | Smith et al. | |
| 4,248,698 | A | 2/1981 | Keller, Jr. | |
| 4,249,699 | A | 2/1981 | Smith et al. | |
| 4,484,928 | A | 11/1984 | Keller, Jr. | |
| 4,613,429 | A | 9/1986 | Chiang et al. | |
| 4,770,766 | A | 9/1988 | Keller, Jr. et al. | |
| 4,830,637 | A | 5/1989 | Wasson | |
| 5,087,269 | A | 2/1992 | Cha | |
| 5,161,694 | A * | 11/1992 | Yoon | B03B 1/04 209/165 |
| 5,236,596 | A | 8/1993 | Greenwald, Sr. | |
| 5,354,345 | A | 10/1994 | Nehls, Jr. | |
| 5,379,902 | A | 1/1995 | Wen et al. | |
| 5,397,001 | A | 3/1995 | Yoon et al. | |
| 5,458,786 | A | 10/1995 | Yoon | |
| 5,459,786 | A | 10/1995 | Tomiyori et al. | |
| 6,053,954 | A | 4/2000 | Anderson et al. | |
| 6,526,675 | B1 * | 3/2003 | Yoon | C09C 1/42 34/424 |
| 6,632,258 | B1 | 10/2003 | Wheelock et al. | |
| 6,855,260 | B1 | 2/2005 | Yoon | |
| 2003/0146134 | A1 | 8/2003 | Yoon | |
| 2008/0053914 | A1 | 3/2008 | Yoon | |
| 2011/0277380 | A1 | 11/2011 | Wibberley | |
| 2017/0101597 | A1 | 4/2017 | Yoon | |

FOREIGN PATENT DOCUMENTS

| | | | |
|---|---|---|---|
| CN | 1099318 | A | 3/1995 |
| CN | 101289265 | | 10/2008 |
| CN | 101778957 | | 7/2012 |
| CN | 101733193 | | 4/2013 |
| RU | 94038258 | | 6/1996 |
| RU | 2099146 | C1 | 12/1997 |
| RU | 2182292 | C2 | 5/2002 |
| WO | 2011-094680 | | 8/2011 |

OTHER PUBLICATIONS

Tsai, Shirley Cheng; Fundamentals of Coal Beneficiation and Utilization, Coal Science and Technology 2; Elsevier Scientific Publishing Company; 1982; pp. 335.
Capes, C.E. et al; "A Survey of Oil Agglomeration in Wet Fine Coal Processing"; Power Technology; 40; 1984; pp. 43-52.
Keller, Jr., D.V. et al; "An Investigation of a Separation Process Involving Liquid-Water-Coal Systems"; Colloids and Surfaces; vol. 22, 1987; pp. 37-50.
Keller, Jr., D.V. et al; "The Demineralization of Coal Using Selective Agglomeration by the T-Process"; Coal Preparation; vol. 8; 1990; pp. 1-17.
Fuerstenau, Douglas W. et al; "Challenges in Mineral Processing"; Society of Mining Engineers, Inc.; 1989; pp. 237-251.
Cooper, M.H. et al; "The Licado Coal Cleaning Process: A Strategy for Reducing SO2 Emissions from Fossil-Fuled Power Plants"; Proceeding of the 25th Intersociety Energy Conversion Engineering Conference; Aug. 12-17, 1990; pp. 137-142.
Binks, B.P.; "Particles as Surfactants—Similarities and Differences"; Current Opinion in Colloid & Interface Science, vol. 7, 2002, pp. 21-41.
Binks, B.P. et al; "Particles Adsorbed at the Oil—Water Interface: A Theoretical Comparison Between Spheres of Uniform Wettability and "Janus" Particles"; Langmuir; vol. 17; 2001; p. 4708.
Glaser et al; "Janus Particles at Liquid-Liquid Interfaces"; Langmuir; vol. 22; 2006; p. 5227.
International Preliminary Report and Written Opinion dated Oct. 18, 2013 in corresponding to PCT/US2013/045199.
Examination Report No. 1 dated Mar. 19, 2019 in corresponding Australian Patent Application No. 2018202003.
Chilean Office Action dated Feb. 9, 2016 in connection with related Chilean Patent Application No. 3345-14.
Chilean Office Action dated Sep. 29, 2016 in connection with related Chilean Patent Application No. 3345-14.
Supplementary European Search Report dated Feb. 26, 2016 in connection with related European Patent Application No. 13804117.3.
Chinese Office Action dated May 27, 2017 in connection with related Chinese Patent Application No. 201380030621.8.
Chinese Office Action dated Nov. 22, 2016 in connection with related Chinese Patent Application No. 201380030621.8.
Chinese Office Action dated Apr. 6, 2016 in connection with related Chinese Patent Application No. 201380030621.8.
Russian Office Action dated Apr. 26, 2017 in connection with related Russian Patent Application No. 2014152482.
Australian Office Action dated Oct. 8, 2015 in connection with related Australian Patent Application No. 2011210630.
Australian Office Action dated Oct. 10, 2016 in connection with related Australian Patent Application No. 2011210630.
Chinese Office Action dated Jul. 3, 2013 in connection with related Chinese Patent Application No. 201180016309.4.
Chinese Office Action dated Apr. 9, 2014 in connection with related Chinese Patent Application No. 201180016309.4.
Australian Office Action dated Mar. 23, 2017 in connection with related Australian Patent Application No. 2013274408.
International Search Report dated Oct. 18, 2011 in connection with related PCT Patent Application No. PCT/US11/23161.
International Search Report and Written Opinion dated Oct. 18, 2013 in connection with related PCT Patent Application No. PCT/US13/45199.
Brazilian Office Action dated Nov. 8, 2019 in corresponding Brazilian Patent Application Serial No. BR112014030622-2.
Chinese Office Action dated Aug. 22, 2019 in corresponding Chinese Patent Application Serial No. 201810154151.0 (with English translation).
"Flotation"; National Vocational Training Teaching Steering Committee Coal Professional Committee; pp. 20-21; Beijing: Coal Industry Press, Jul. 2014; Common Knowledge evidence. No English translation available. Explanation of concise relevance may be found in the Chinese Office Action dated Aug. 22, 2019 in corresponding Chinese Patent Application Serial No. 201810154151.0.
Canadian Office Action dated Aug. 29, 2019 in corresponding Canadian Patent Application Serial No. 2,875,024.

* cited by examiner

CLEANING AND DEWATERING FINE COAL

CROSS-REFERENCE TO RELATED APPLICATIONS

This application is a divisional application of U.S. Non-Provisional application Ser. No. 15/786,079 filed Oct. 17, 2017, Publication No. 2018/0036741; which is a divisional application of U.S. Non-provisional application Ser. No. 13/576,067, now U.S. Pat. No. 9,789,492; which is a national stage completion of PCT/US2011/023161 filed on Jan. 31, 2011, which claims the benefit of U.S. Provisional Application No. 61/300,270, filed on Feb. 1, 2010, the disclosures of which are incorporated herein by reference.

FIELD OF INVENTION

The instant invention pertains to methods of cleaning fine coal of its impurities in aqueous media and removing the process water from both the clean coal and refuse products to the levels that can usually be achieved by thermal drying.

BACKGROUND OF INVENTION

Coal is an organic material that is burned to produce heat for power generation and for industrial and domestic applications. It has inclusions of mineral matter and may contain undesirable elements such as sulfur and mercury. Coal combustion produces large amounts of ash and fugitive dusts that need to be handled properly. Therefore, run-of-the mine coal is cleaned of the mineral matter before utilization, which also helps increase combustion efficiencies and thereby reduces $CO_2$ emissions. In general, coarse coal (50×0.15 mm) can be cleaned efficiently by exploiting the specific gravity differences between the coal and mineral matter, while fine coal (approximately 0.15 mm and smaller) is cleaned by froth flotation.

In flotation, air bubbles are dispersed in water in which fine coal and mineral matter are suspended. Hydrophobic coal particles are selectively collected by a rising stream of air bubbles and form a froth phase on the surface of the aqueous phase, leaving the hydrophilic mineral matter behind. Higher-rank coal particles are usually hydrophobic and, therefore, can be attracted to air bubbles that are also hydrophobic via a mechanism known as hydrophobic interaction. The clean coal product reporting to the froth phase is substantially free of mineral matter but contains a large amount of water. Wet coal is difficult to handle and incurs high shipping costs and lower combustion efficiencies. Therefore, the clean coal product is dewatered using various devices such as cyclones, thickeners, filters, centrifuges, and/or thermal dryers. In general, the cost of dewatering increases with decreasing particle size and can become prohibitive with ultrafine particles, e.g., finer than 44 μm. In such cases, coal producers are forced to discard them. Large amounts of fine coal have been discarded to numerous impoundments worldwide, creating environmental concerns.

Many investigators explored alternative methods of cleaning fine coal, of which selective agglomeration received much attention. In this process, which is also referred to as oil agglomeration or spherical agglomeration, oil is added to an aqueous suspension while being agitated. Under conditions of high-shear agitation, the oil breaks up into small droplets, collide with coal particles, spread on the surface, form pendular bridges between different coal particles, and produce agglomerates. Nicol, et al. (U.S. Pat. No. 4,209,301) found that adding oil in the form of unstable oil-in-water emulsions can produce agglomerates without intense agitation. The agglomerates formed by these processes are usually large enough to be separated from the mineral matter dispersed in water by simple screening. Further, selective agglomeration gives lower-moisture products and higher coal recoveries than froth flotation. On the other hand, it suffers from high dosages of oil.

The amounts of oil used in the selective agglomeration process are typically in the range of 5 to 30% by weight of feed coal (S. C. Tsai, in Fundamentals of Coal Beneficiation and Utilization, Elsevier, 1982, p. 335). At low dosages, agglomerates have void spaces in between the particles constituting agglomerates that are filled-up with water, in which fine mineral matter, e.g., clay, is dispersed, which in turn makes it difficult to obtain low moisture- and low-ash products. Attempts were made to overcome this problem by using sufficiently large amounts of oil so that the void spaces are filled-up with oil and thereby minimize the entrapment of fine mineral matter. Capes et al (Powder Technology, vol. 40, 1984, pp. 43-52) found indeed that the moisture contents were in excess of 50% by weight when the amount of oil used was less than 5%. By increasing the oil dosage to 35%, the moisture contents were substantially reduced to the range of 17-18%.

Keller et al. (Colloids and Surfaces, vol. 22, 1987, pp. 37-50) increased the dosages of oil to 55-56% by volume to fill up the void spaces more completely, which practically eliminated the entrapment problem and produced super-clean coal containing less than 1-2% ash. However, the moisture contents remained high. Keller (Canadian Patent No. 1,198,704) obtained 40% moisture products using fluorinated hydrocarbons as agglomerants. Depending on the types of coal tested, approximately 7-30% of the moisture was due to the water adhering onto the surface of coal, while the rest was due to the massive water globules trapped in the agglomerates (Keller et al., Coal Preparation, vol. 8, 1990, pp. 1-17).

Smith, ea al. (U.S. Pat. No. 4,244,699) and Keller (U.S. Pat. No. 4,248,698; Canadian Patent No. 1,198,704) used fluorinated hydrocarbon oils with low boiling points (40-159° F.) so that the spent agglomerants can be readily recovered and be recycled. These reagents are known to have undesirable effect on the atmospheric ozone layer. Therefore, Keller (U.S. Pat. No. 4,484,928) and Keller, et al. (U.S. Pat. No. 4,770,766) disclosed methods of using short chain hydrocarbons, e.g., 2-methyl butane, pentane, and heptanes as agglomerants. These reagents also have relatively low boiling points, allowing them to be recycled.

Being able to recycle an agglomerant would be a significant step toward eliminating the barrier to commercialization of the selective agglomeration process. Another way to achieve this goal would be to substantially reduce the amount of the oils used. Capes (in Challenges in Mineral Processing, ed. by K. V. S. Sastry and M. C. Fuerstenau, Society of Mining Engineers, Inc., 1989, pp. 237-251) developed the low-oil agglomeration process, in which the smaller agglomerates (<1 mm) formed at low dosages of oil (0.5-5%) are separated from mineral matter by flotation rather than by screening. Similarly, Wheelock et al., (U.S. Pat. No. 6,632,258) developed a method of selectively agglomerating coal using microscopic gas bubbles to limit the oil consumption to 0.3-3% by weight of coal.

Chang et al. (U.S. Pat. No. 4,613,429) disclosed a method of cleaning fine coal of mineral matter by selective transport of particles across the water/liquid carbon dioxide interface. The liquid $CO_2$ can be recycled. A report shows that the clean coal products obtained using this liquid carbon dioxide (LICADO) process contained 5-15% moisture after filtration (Cooper et al., Proceedings of the 25th Intersociety Energy Conversion Engineering Conference, 1990, Aug. 12-17, 1990, pp. 137-142).

Yoon et al. (U.S. Pat. No. 5,459,786) disclosed a method of dewatering fine coal using recyclable non-polar liquids. The dewatering is achieved by allowing the liquids to displace surface moisture. Yoon reports that the process of dewatering by displacement (DBD) is capable of achieving the same or better level of moisture reduction than thermal drying at substantially lower energy coats, but does not show the removal of mineral matter from coal.

SUMMARY OF INVENTION

It is an object of the invention to provide a method of cleaning fine coal suspended in water of its mineral matter and simultaneously dewatering the clean coal product by displacing the water adhering to the surface of coal with a hydrophobic liquid. It is also an object to remove the water entrapped in between the fine particles by subjecting the particulate material to a high-shear agitation in a gaseous phase. In this invention, fine coal refers to coal containing particles mostly smaller than 1 mm in diameter, but the most significant benefits of this invention can be realized with fine coal containing particles less than 0.25 mm.

According to the invention, a hydrophobic liquid is added to an aqueous medium, in which fine coal is dispersed, and the suspension (or slurry) is agitated. Addition of the hydrophobic liquid can take place when the suspension (or shiny) is being agitated. The hydrophobic liquid is chosen so that its contact angle on the coal surface, as measured through the aqueous phase, is larger than 90°. Use of such a liquid allows coal particles to be engulfed (or transported) into the hydrophobic liquid phase, leaving hydrophilic mineral matter in the aqueous phase. The amount of the hydrophobic liquid to be added should be large enough so that all of the recoverable coal particles can be engulfed (or immersed) into the hydrophobic liquid phase. The coal particles engulfed into the hydrophobic liquid phase are essentially dry because the water in contact with the hydrophobic surface is displaced spontaneously by the hydrophobic liquid during the process of engulfment. However, the dewatering by displacement (DBD) process has a problem in that significant amounts of the process water can be entrained into the organic phase in the form of water drops stabilized by hydrophobic coal particles. It is well known that particles with contact angles larger than 90° stabilize water drops in oil phase forming a water-in-oil emulsion (Binks, Current Opinion in Colloid and Interface Science, vol 7, 2002, pp. 21-41). It has been found that much of the water entrained into the hydrophobic liquid phase is present as large globules.

As noted by Keller et al. (Coal Preparation, vol. 8, 1990, pp. 1-17), large globules of water are also formed in conventional oil agglomeration processes, in which the amounts of oil added to aqueous slurry of fine coal are in the range of 5 to 56% by volume (a similar range may be used in the practice of the instant invention; however, other ranges might be used, e.g., 5 to 56% by weight, more than 20% by volume or weight, less than 20% by volume or weight, etc). Obviously, the water-in-oil emulsions are still being formed during oil agglomeration processes, which may be an explanation for the high moistures of the clean coal products obtained from these processes.

The hydrophobic liquid containing dry coal particles and entrained water as water-in-oil emulsion is phase-separated from the aqueous phase containing hydrophilic mineral matter. In one embodiment of the present invention, the hydrophobic liquid is transferred to a size-size separator, such as screen, classifier, and/or cyclone, to remove the globules of water from the dry coal particles. The smaller size fraction (e.g., screen underflow) consists of the dry coal particles, while the larger size fraction (e.g., screen overflow) consists of the water globules stabilized by coal particles. If the dry coal yield is low, depending on the efficiency of the size-size separation and the size of coal, the larger size fraction can be re-dispersed in water and subjected to another set of agitation and screening to recover additional coal. In a continuous operation, the larger size fraction may be returned to the feed stream to allow the misplaced coal particles to have another opportunity to be recovered. In this embodiment, the larger globules of water can be readily removed. It would be difficult, however, to remove the smaller droplets stabilized by finer coal particles using the currently available size-size separation technologies, making it difficult to obtain effectively dry coal particles containing less than 1% moisture. If such low moistures are not desired, one can increase the cut size of the size-size separation step, e.g., by increasing the screen aperture, to obtain higher moistures, e.g., 5 to 10% by weight. The clean coal product which is now substantially free of mineral matter and surface moisture may then be subjected to a process, in which a small amount of residual hydrophobic liquid is recovered and recycled.

In another embodiment, the water droplets (or globules) are broken up using an appropriate mechanical means such as ultrasonic vibration so that the hydrophobic coal particles are detached from the water droplets (or globules) and dispersed in the hydrophobic liquid. The organic liquid phase in which the coal particles are dispersed is separated from the aqueous phase in which hydrophilic mineral matter is dispersed, and then subjected to appropriate solid-liquid separation means such as settling, filtration and/or centrifugation. The recovered hydrophobic liquid is recycled. The small amount of the hydrophobic liquid that may be adhering onto the surface of the hydrophobic particles (or solids) obtained from the solid-liquid separation step is also recovered and recycled using processes that may involve vaporization and condensation.

In still another embodiment, the hydrophobic liquid, in which dry coal and water globules are dispersed, is subjected to a solid-liquid separation using a centrifuge, filter, roller press, or other suitable separator. In this embodiment, the water-in-oil emulsions become smaller in size by expression and drainage, leaving only very small droplets of water trapped in between particles. In the instant invention, the entrapped interstitial water is released by disturbing the cake structure, in which the small droplets are entrapped, by high-shear agitation. The tiny water droplets may vaporize or exit the system. Thus, a combination of the solid-liquid separation involving expression and drainage and the additional step involving high-shear agitation allows the moisture contents to be reduced to less than 8% by weight, the levels that can usually be achieved by thermal drying. The extent of the moisture reduction can be achieved by controlling the process of high-shear agitation in terms of agitation intensity, duration, and devices employed.

The hydrophobic liquids used in most of the embodiments of the instant invention are recovered and recycled. Bulk of the liquid is recovered without involving phase changes, while only the small amount of the residual hydrophobic liquid adhering onto the surface of hydrophobic particles (e.g., coal) is recovered by vaporization and condensation. If the liquid has a boiling point below the ambient, much of the processing steps described above are carried out in pressurized reactors. In this case, the small amount of the residual hydrophobic liquid can be recovered in gaseous form by pressure release, which is subsequently converted back to liquid before returning to the circuit. If the boiling point is above the ambient, the hydrophobic liquid is recovered by evaporation. Thermodynamically, the energy required to vaporize and condense the recyclable hydrophobic liquids disclosed in the instant invention is substantially less than that required to vaporize water from the surface of coal particles.

It has been found that the high-shear dewatering (HSD) process can also be used for the clean coal product obtained by a process not involving the DBD or oil agglomeration process described in the instant invention, e.g., flotation. It is necessary, however, that the clean coal product be dewatered by filtration, centrifugation or any other method to produce a cake in which small droplets of water are trapped in between the coal particles. The HSD process can also be used to remove the water from a filter cake formed by hydrophilic particles such as silica and clay.

It is, therefore, an object of the invention to remove inorganic mineral matter from fine coal and simultaneously remove water from the product using a hydrophobic liquid. The invention may be practiced with different types of coal including without limitation bituminous coal, anthracite, and subbituminous coal.

It is another object of this invention to further reduce the moisture of clean coal product to the extent that they can be dried without using excessive heat.

It is still another object of the invention to further reduce the moisture of the particulate materials obtained using dewatering methods such as filtration, centrifugation, or expression, by subjecting them to high-shear agitation.

It is still another object to recover the spent hydrophobic liquid for recycling purposes.

DESCRIPTION OF THE DRAWINGS

These and other objects of the invention will be fully understood from the following description of the invention in reference to the figures attached hereto.

DETAILED DESCRIPTION

Two hydrophobic entities in an aqueous environment are attracted to each other. This is a phenomenon known as hydrophobic interaction. Thus, with reference to FIG. 1*a*, when a hydrophobic coal particle 1 encounters a hydrocarbon liquid 2 in water 3, the latter can spread on the surface, or the former can be engulfed into the latter, during the course of which the water molecules on the surface are displaced by the hydrophobic liquid.

Figures 1A, 1B:
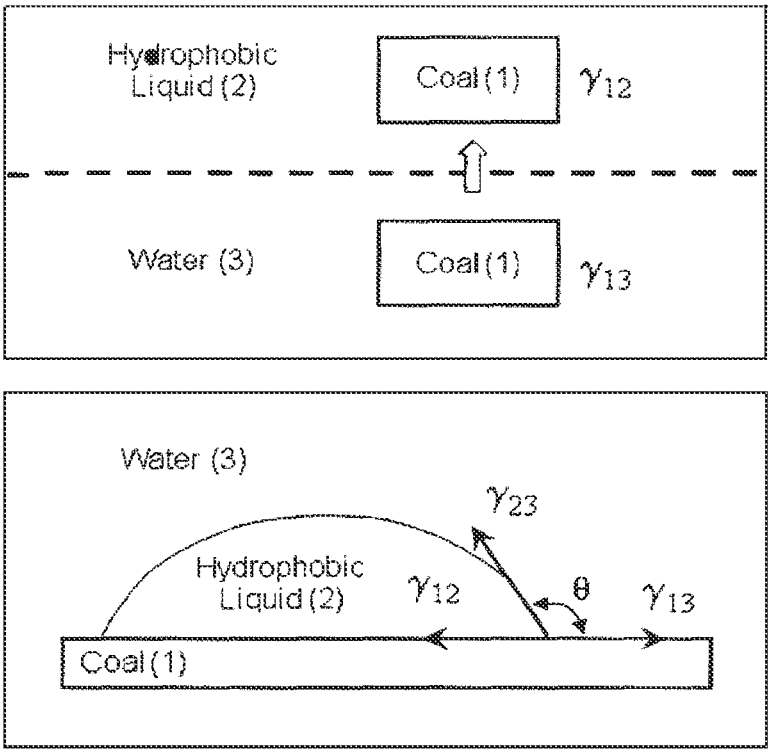
FIGS. 1*a* and 1*b* illustrate the concept of dewatering by displacement for coal.

The process of dewatering by displacement (DBD) may be depicted schematically by FIGS. 1*a* and 1*b*. The change in Gibbs free energy per unit area (dG/dA) associated with the process is given by the following relationship, $$dG/dA=\gamma_{12}-\gamma_{13} \quad [1]$$

where $\gamma_{12}$ and $\gamma_{13}$ are the interfacial tensions at the coal/hydrophobic liquid and coal/water interfaces, respectively. For the displacement process to be spontaneous, dG/dA must be less than zero.

FIG. 1*b* shows the contact angle (θ) measured through the aqueous phase of a hydrophobic liquid placed on a coal surface in water. At the three-phase contact, one can apply the Young's equation:

$$\gamma_{12}-\gamma_{13}=\gamma_{23}\cos\theta \quad [2]$$

in which $\gamma_{23}$ is the interfacial tension between water and hydrophobic liquid. By combining these two equations, one obtains the following relationship:

$$dG/dA=\gamma_{23}\cos\theta<0 \quad [3]$$

for the spontaneous displacement (dewatering) of water from the surface of coal. According to this relation, the free energy change becomes negative when θ>90°.

Figure 2:
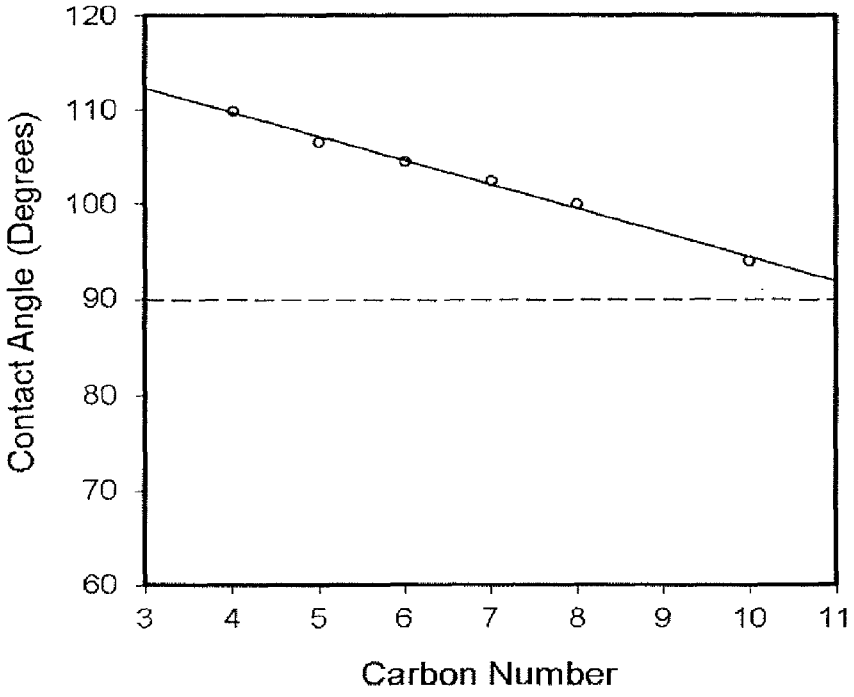
FIG. 2 is a graph showing the contact angles of n-alkane hydrophobic liquids on the surface of a hydrophobic coal immersed in water.

We measured the contact angles of n-alkanes on the polished surface of a bituminous coal sample from the Moss No. 3 coal preparation plant, Virginia. As shown in FIG. 2, the contact angles increased with decreasing chain length, and the contact angles were larger than 90°. Thus, all of the n-alkanes used for the contact angle measurements can be used to displace the water from the coal surface. That the contact angle increased with decreasing hydrocarbon chain length suggests that the shorter chain n-alkanes would be a better hydrophobic liquid to be used to displace the water from the coal surface. An added advantage of using a shorter-chain n-alkane is that they can more readily be recycled than the longer chain homologues due to their lower boiling point. One can also use liquid carbon dioxide, which is a well-known hydrophobic liquid.

The process described above can be used to simultaneously remove both the mineral matter and water from the coal particles dispersed in water. However, it has not been previously recognized that the process has an inherent problem of entrapping water into the clean coal products, as is the case with the selective agglomeration (or oil agglomeration) processes. We have already discussed two mechanisms of entrapping water: one is the entrapment of water in the void spaces formed between the particles constituting agglomerates, and the other is the formation of water-in-oil emulsions. The former may be addressed by using larger amounts of oil as suggested by Keller et al. (Colloids and Surfaces, vol. 22, 1987, pp. 37-50), while the latter can be addressed as disclosed m the present invention.

It is well known that colloidal particles with contact angles (θ), measured through the aqueous phase, that are close to 90° can readily adsorb at an oil-water interface and produce oil-in-water or water-in-oil emulsions (Binks, Current Opinion in Colloid and Interface Science, vol. 7, 2002, pp. 21-41). For spherical particles, water-in-oil emulsions are formed when θ>90°, while oil-in-water emulsions are formed when θ<90°. The energy (E) required to detach a spherical particle of radius r from an oil/water interface, whose interfacial tension is $\gamma_{23}$, is given by $$E=\pi r^2\gamma_{23}(1\pm\cos\theta) \quad [4]$$

The sign in the bracket is negative for the removal of particles into aqueous phase and positive for removal into oil phase. Eq. [4] suggests that if θ is slightly less than 90°, the particles will be held at the oil/water interface and stabilize oil-in-water emulsions. If θ is slightly above 90°, however, the particles will be held at the interface forming water-in-oil emulsions. In this regard, it is not surprising that Keller et al. (Coal Preparation, vo. 8, 1990, pp. 1-17) reported the observation of "massive water globules", which was responsible for the high moisture contents of the clean coal products obtained from the selective agglomeration process. This was probably one of the reasons that Keller et al. explored the possibility of using the clean coal products as feedstock for coal-water slurry manufacture.

Eq. [4] suggests also that if coal particles have a high contact angle, the detachment energy (E) becomes small and hence they remain dispersed in oil phase. As shown in FIG. 2, θ increases with decreasing carbon number of n-alkanes; therefore, a shorter chain n-alkane would work better in the DBD process disclosed in the present invention. On the other hand, the particles (e.g., clay) whose contact angles are well below 90°, they will remain dispersed in aqueous phase. Further, the DBD process should work better with finer particles in the feed, because according to Eq. [4] smaller coal particles should be more readily dispersed in the hydrophobic liquid phase than coarser particles.

Binks et al. (Langmuir, vol. 17, 2001, p. 4708) suggested that Janus particles, i.e., bifacial particles consisting of hydrophilic and hydrophobic surfaces, should improve the stability of the emulsions stabilized by "solid surfactants". Glaser et al. (Langmuir, vol. 22, 2006, p. 5227) showed actually that Janus particles reduce the tension (or excess free energy) at the water/oil interfaces substantially and thereby create favorable conditions for the formation of stable water-in-oil emulsions. Therefore, for cleaning a run-of-the-mine fine coal containing significant amounts of Janus particles (or composite particles), it would be difficult to avoid the formation of water-in-oil emulsions, with a consequence of high moisture products.

Due to the presence of the entrained water, the clean coal products obtained in conventional oil agglomeration processes exhibit high moisture contents, typically in the range of 30-55% by weight. In the instant invention, methods of removing the entrained water have been developed so that the moisture can be readily reduced to substantially lower levels. In one embodiment, the globules of water are removed using a size-size separation method selected from those including but not limited to screens, classifiers, and cyclones. These methods can remove the globules of water that are considerably larger than coal particles.

In another embodiment, the water drops stabilized by hydrophobic coal particles are broken up by appropriate mechanical means such as ultrasonic vibrator, magnetic vibrator, grid vibrator, etc., so that the coal particles are dispersed in the hydrophobic liquid, while the water drops free of coal particles drain into the aqueous phase. The organic phase in which coal particles are dispersed are then phase separated from the aqueous phase in which mineral matter is dispersed. The former is subjected to appropriate solid-liquid separation, while the latter is drained off. The hydrophobic liquid recovered from the solid-liquid separation step is recycled. The clean coal particles obtained from the solid/liquid separation step are substantially free of surface moisture. However, a small amount of the hydrophobic liquid may be present on the coal surface, in which case the coal particles may be subjected to a negative pressure or gentle heating to recover the residual hydrophobic liquid as vapor, which is subsequently condensed back to a liquid phase and recycled.

In still another embodiment, the drops (or globules) of water are removed using a solid-liquid separation method selected from those including but not limited to filters, centrifuges, and presses. It is believed that much of the entrained water globules are expressed and/or drained during the solid-liquid separation process, leaving behind only the interstitial water droplets entrapped in between the particles constituting a filter cake. The filter cake is then subjected to a high-shear agitation to dislodge the entrapped water droplets from surrounding coal particles and release them to the vapor phase in which they can readily vaporize due to the large surface-to-volume ratio and higher vapor pressure due to large radius of curvature. Some of the released water droplets may exit the system into the atmosphere.

The process of cleaning coal by selective agglomeration requires high-intensity agitation. Nicol et al. (U.S. Pat. No. 4,209,301) stated that high-speed stirrers capable of providing greater than 10,000 r.p.m. are needed to observe phase inversion, i.e., completion of coal agglomerates. It was shown also that the phase inversion is observed after 8 minutes of agitation at 6,000 r.p.m, while it takes 18 minutes at 3,000 r.p.m. In contrast, in the present invention, neither high-speed agitation nor long periods of agitation is necessary. A gentle agitation is usually sufficient, although high energy input in the form of strong agitation or long agitation time has no harmful effect.

Figure 3:
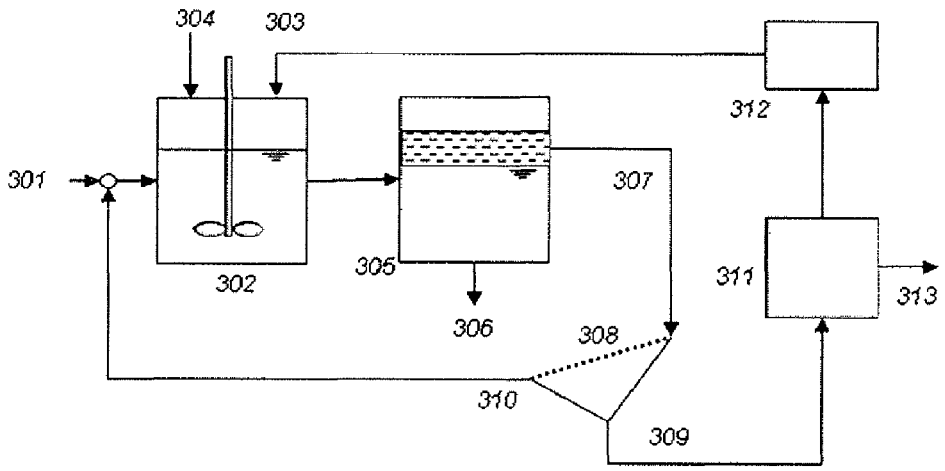
FIG. 3 is a schematic representation of one embodiment for the present invention.

FIG. 3 shows an example of the first embodiment of the instant invention. Coal slurry 301 is fed to a mixing tank 302, along with a hydrophobic liquid 303 recovered downstream and a small amount of make-up hydrophobic liquid 304. In the mixing tank 302, the hydrophobic liquid is broken to small droplets, which in turn undergo hydrophobic interactions with coal particles. The mixed slurry is transferred to a phase separator 305, in which hydrophobic liquid and water are phase-separated. When a sufficient amount of hydrophobic liquid is used, the coal particles are engulfed into the liquid phase, while mineral matter is left behind in the aqueous phase. The latter 306 containing mineral matter is removed as reject, and the former 307 containing both the coal particles free of surface moisture and the globules of water stabilized by coal particles overflows onto a size-size separator (e.g., screen) 308. The hydrophobic liquid and the coal particles dispersed in it report to the smaller size fraction 309, i.e., underflow. The coal particles dispersed in the hydrophobic liquid is practically free of surface moisture due to the dewatering (or drying) by displacement (DBD) mechanism depicted in FIG. 1. On the other hand, the globules of water formed and entrained into the hydrophobic liquid phase during mixing 302 and phase separation 305 report to the larger size fraction 310, i.e., overflow. The overflow stream 310 is returned to the mixing tank 302 to give the misplaced coal particles another opportunity to be recovered to the underflow stream 309 of the size-size separator 308. The underflow stream 309 consists of clean coal particles and the spent hydrophobic liquid. If the amount of hydrophobic liquid 303, 304 used in this embodiment is small relative to the amount of the coal in the feed stream 301, as in oil agglomeration, the underflow 309 would consist mainly of coal particles and a relatively small amount spent hydrophobic liquid adhering to the coal surface. In this case, the underflow 309 is fed directly to the hydrophobic liquid recovery system 311, where the spent hydrophobic liquid is recovered by vaporization, and subsequently transformed to liquid 303 by means of a compressor and/or condenser 312 before being returned to the mixer 302. The solid 313 leaving the hydrophobic liquid recovery system 311 represents the clean coal product with low moisture. The coal recovery and the moisture content of the product coal would vary depending on the efficiency of the size-size separator 308 and the size distribution of the water droplets stabilized by coal particles. For the case of using screen for size-size separation, the use of multiple-deck screens may be useful to control coal recovery and product moisture. If the amount of the hydrophobic liquid reporting to the underflow 309 is small or the cost of the liquid is not insurmountable, one may bypass the recovery system 311, 312. When using a large amount of a hydrophobic liquid, it may be separated from the coal present in the underflow stream 309 by solid-liquid separation before feeding the underflow stream 309 to the recovery system 310, 311.

Figure 4:
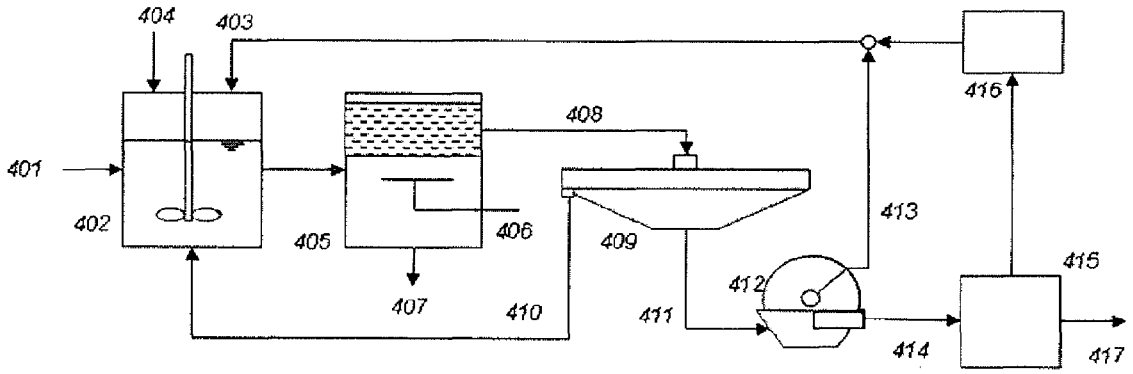
FIG. 4 is a schematic representation of another embodiment of the present invention.

FIG. 4 shows another embodiment of the present invention, in which the amount of the hydrophobic liquid used is large. The front end is the same as in FIG. 3 in that coal slurry 401 is mixed 402 with the hydrophobic liquid recovered downstream 403 and added as a make-up source 404. A novel feature of this embodiment is that the water droplets (or globules) stabilized by coal particles are broken up in the phase separator 405 by means of an appropriate mechanical means 406 (e.g. sonic or magnetic vibrator), so that the coal particles are more fully dispersed in the hydrophobic liquid phase. The aqueous phase containing mineral matter is removed as reject 407. The overflow 408 from the phase separator 405 is directed to a settler (e.g., thickener) 409, in which coal particles settle to the bottom and the hydrophobic liquid is recovered as overflow 410 and returned to the mixer 402. The settled material 411 is then subjected to another type of solid-liquid separation (e.g., filtration) 412, with the separated liquid (or filtrate) 413 being returned to the mixer 402. The dry coal product 414 is then subjected to the hydrophobic liquid recovery system 415, 416 to recover the small amount of the residual hydrophobic liquid adhering to the surface of coal in the same manner as in FIG. 3. The exit stream 417 from the recovery system 415 represents a low-ash and low-moisture clean coal product.

Figure 5:
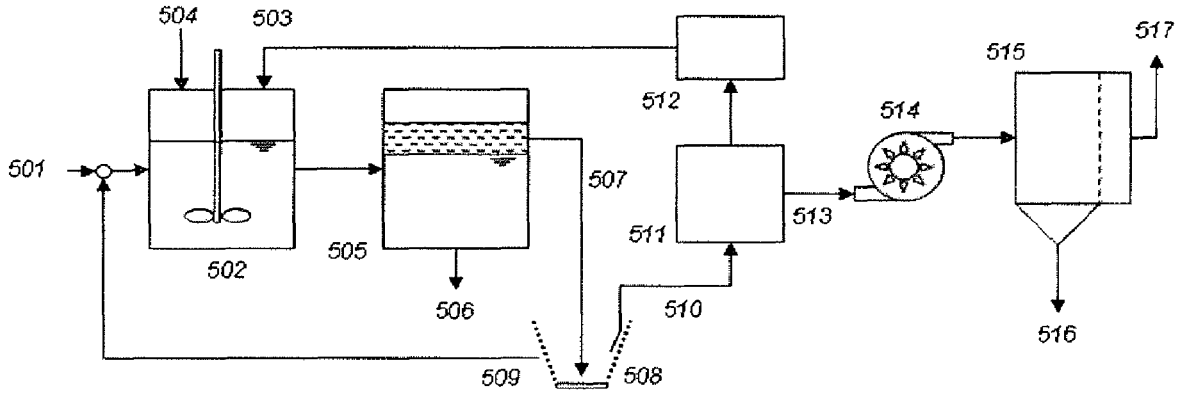
FIG. 5 is a schematic representation of still another embodiment of the present invention.

FIG. 5 represents still another embodiment of the instant invention. The front end of the process is the same as the first and second embodiments shown in FIGS. 3 and 4, where coal slurry 501 is fed to a mixing tank 502 which receives hydrophobic liquid recovered downstream 503 and added as a make-up source 504. The mixture is fed to a phase separator 505, in which the hydrophobic liquid containing coal and the aqueous phase containing mineral matter are phase separated. The latter is removed as reject 506, while the former 507 is fed to a solid-liquid separator 508 (e.g., centrifuge), where much of the spent hydrophobic liquid recovered as underflow 509 is returned to the mixer 502. The overflow 510 containing coal particles, a small amount of residual hydrophobic liquid adhering to the coal surface, and the tiny droplets of water trapped in between coal particles is then fed to the hydrophobic liquid recovery system 511, 512 to recover the spent hydrophobic liquid 503 for recycle. The discharge 513 from the recovery system 511 may have a desirable amount of moisture for downstream processing such as briquetting. If not, it may be subjected to a high-shear dewatering (HSD) device 514, in which the tiny droplets of water are dislodged from coal or vaporized quickly due to the large surface area-to-volume ratio. The exit from the HSD device 514 is fed to a dry coal collection device 515 such as bag house or cyclone, where coal particles are collected as underflow 516 and the liberated water droplets and/or water vapor 517 exit(s) the collection device. The HSD device 513 may be selected from but not limited to dynamic or static mixer, rotating fan, fluidized-bed, vibrating screen, and air jet. The HSD process can reduce the moisture of coal to less than 8%, a level that can usually be achieved by thermal drying. The moisture level can be controlled by adjusting the rate and duration of high-shear agitation. Although the HSD process works well without an external heat source, the use of heated air may facilitate the process or reduce moisture to a lower level.

It has been found that the HSD process can be used not only for drying hydrophobic coal fines but also for drying hydrophilic mineral fines (e.g., minerals in reject 306, 407, and 506 in FIGS. 3-5). For the latter, an aqueous suspension of mineral matter or any other hydrophilic particulate materials is dewatered first by using a conventional process, such as centrifuge, filter, or roller press, to form a filter cake, in which a small amount of water is entrapped at the void spaces formed in between the fine particles. The filter cake is then subjected to the HSD method described above.

The hydrophobic liquids that can be used for the processes described in the present invention include hydrocarbon oils, which include aliphatic and aromatic hydrocarbons whose carbon numbers are less than 18. For the dewatering by displacement (DBD) process, shorter-chain n-alkanes and alkenes, both unbranched and branched, and cycloalkanes and cycloalkenes, with carbon numbers of less than eight may be used so that the spent hydrocarbon oils can be readily recovered and recycled. Liquid carbon dioxide is another hydrophobic liquid that can be used for the DBD process.

When using longer-chain alkanes and alkenes, recycling may be difficult. Therefore, in these instances only small amounts of the reagents are preferably used as agglomerants. The reagent costs can be reduced by using the hydrophobic liquids from unrefined petroleum sources. For the DBD process, ligroin (light naphtha), naphtha and petroleum naphtha, diesel fuel, and mixtures thereof may be used. For selective agglomeration, small amounts of kerosene and heating oils whose carbon numbers are in the range of 12-18 may be used.

The DBD and selective agglomeration processes are ideally suited for separating hydrophobic particulate materials (e.g., high-rank coals) from hydrophilic materials (e.g., silica and clay), with the resulting hydrophobic materials having very low surface moistures. The processes as described in the instant invention can also be used for separating one-type of hydrophilic materials from another by selectively hydrophobizing one but not the other(s). For example, the processes can be used to separate copper sulfide minerals from siliceous gangue minerals by using an alkyl xanthate or a thionocarbamate as hydrophobizing agents for the sulfide minerals. Further, the DBD concept can be used for non-thermal drying of fine coal or any other particulate materials after appropriate hydrophobization.

EXAMPLES

Example 1

A volume of pentane was added as a hydrophobic liquid to the coal slurry placed in a 350 ml glass separatory funnel. The coal slurry was received from the Moss 3 coal preparation plant, Virginia, at 15% solids by weight. With a stopper in place, the material in the funnel was agitated vigorously by handshaking for 4 minutes and let to stand for phase separation. Coal particles agglomerated (or were engulfed into the hydrophobic liquid) and formed a layer on top of the aqueous phase. By opening the stopcock at the bottom, the aqueous phase was removed along with the mineral matter dispersed in it. The hydrophobic liquid remaining in the funnel was agitated again for a short period of time and let to stand. It was found that large globules of water surrounded by coal particles settled at the bottom. By opening the stopcock, the water globules were removed. This procedure was repeated several times until no visible water globules could be detected. The coal sample left in the funnel was removed, and the pentane was allowed to evaporate completely before analyzing the sample for moisture content. As shown in Table 1, the clean coal product still contained 25.9% moisture, indicating that smaller droplets of water were still present in the form of a water-in-oil emulsion with hydrophobic coal particles acting as a

TABLE 1

| No Screening | | | Screening | | |
|---|---|---|---|---|---|
| | Recovery* (%) | Moisture (% wt) | | Recovery* (%) | Moisture (% wt) |
| Clean Coal | 94.78 | 25.9 | Underflow | 84.2 | 2.4 |
| | | | Overflow | 8.3 | 58.2 |
| Feed | 100.00 | | Feed | 100.00 | 89.8 |

*weight recovery solid surfactant.

In another test, the clean coal product obtained in the manner described above was screened at 60 mesh. It was found that the screen underflow assayed only 2.4% moisture, while the screen overflow assayed 58.2% moisture. This example demonstrated that the high moisture content of the clean coal product was due to the presence of the globules of water stabilized by hydrophobic coal particles, which could readily be removed by a size-size separation step to reduce the moisture content substantially.

Example 2

Another test was conducted in the same manner as described in Example 1 on a fine coal sample (100 mesh×0) from the Cardinal coal preparation plant, West Virginia. This sample was much finer than the one used in Example 1, with 80% of the material finer than 44 μm. In this example, 800 ml of the slurry at 4.3% solids was placed in a 1 liter separatory funnel along with 200 lb/ton of pentane as a hydrophobic liquid. After agitation and settling, the aqueous phase containing mineral matter was drained off and the pentane mixed with coal particles was left behind in the funnel. The excess pentane was allowed to evaporate, and the clean coal product analyzed for ash and moisture. As shown in Table 2, the ash content was reduced from 35.6% in the feed to 3.7% with a combustible recovery of 83.7%, but the moisture was as high as 48.7%. The high moisture content was again due to the entrainment of the water droplets stabilized by coal particles.

The procedure described above was similar to the method of dewatering disclosed by Yoon et al. (U.S. Pat. No. 5,458,786), who reported that the moisture of a Pittsburgh coal sample was reduced to 3.6% using liquid butane as hydrophobic liquid. However, the low moisture value reported was due to a sampling error. In U.S. Pat. No. 5,458,786, the aqueous phase was drained until the "mixture of butane and coal began to come out of the tubing". It appears now that by the time the drainage process was stopped, most of the water globules settled at the phase boundary had already been drained out. The phase boundary could not be seen because the test was conducted in copper tubing. Also, the mechanism of hydrophobic particles stabilizing water-in-oil emulsions was not known at the time. Yoon et al. failed to

TABLE 2

| Product | Ash (%) | Moisture (%) | Recovery* (%) |
|---|---|---|---|
| Clean Coal | 3.7 | 48.7 | 83.7 |
| Reject | 76.2 | — | 16.3 |
| Feed | 35.6 | — | 100.0 |

*combustible recovery recognize the difficulty in sampling under such circumstances.

Example 3

The same coal sample used in Example 2 was subjected to another test under identical conditions, except that an additional step was taken to remove the entrained globules of water and obtain low moisture products. The additional step involved the use of a screen to separate the water droplets from the dry fine coal particles obtained by the DBD process depicted in FIG. 1. In this example, the clean coal product obtained using the procedure described in Example 2 was screened to obtain dry coal particles as screen underflow and water droplets as screen overflow. Initially, a 140-mesh screen was used for the separation, in which case the amount of dry coal obtained was only about 25% by weigh of the feed. Therefore, the screen overflow was subjected to another stage of the DBD process, and the product was screened again to obtain additional recovery of dry coal. When using a 100 mesh screen, the recovery was significantly higher, but the moisture was also higher because smaller water droplets that passed through the larger screen. Table 3 summarizes the results obtained after several stages of screening. As shown, the moisture was reduced to 4.6%, which was substantially lower than in Example 2. Note also that the process described in this invention disclosure also produced low-ash clean coal products. Thus, the DBD process as described in the instant invention is capable of removing both mineral

TABLE 3

| Product | Ash (%) | Moisture (%) | Recovery (%) |
|---|---|---|---|
| Clean Coal | 3.8 | 4.6 | 75.7 |
| Reject | 68.3 | — | 24.3 |
| Feed | 35.6 | — | 100.0 |

matter from a fine coal slurry generated at an operating coal preparation plant and the entrained water from the clean coal product.

Example 4

A volume (600 ml) of the fine coal slurry (100 mesh×0) from the Cardinal plant was placed in a 1-litter separatory funnel, and pentane was added in the amount of 20% by weight of coal. With the stopper in place, the funnel was vigorously agitated by hand for 2 minutes, and the mixture was allowed to stand for phase separation. The aqueous phase containing mineral matter was removed from the bottom, and the pentane and coal mixture removed from the top. During this procedure, the mineral matter was substantially removed from coal, and most of the pentane evaporated away from the clean coal product. However, the moisture content remained as high as 52.2%, as shown in Table 4, mostly due to the entrained water globules stabilized by hydrophobic coal particles. The clean coal product was dewatered by a horizontal basket centrifuge to reduce the moisture content to 18.2%. The centrifuge product was then fed to a squirrel-cage fan by means of a vibratory feeder. The exit stream from the fan was collected in a small home-made bag house. The collected coal sample assayed 1% moisture, as shown in the table. Thus, the method disclosed in this example produced a dry coal with 1% moisture with the ash content reduced from 36.7 to 8.6% with a 90% combustible recovery. The ash content could have been reduced further, if the clean coal product was re-pulped and cleaned again before the centrifugation and high-shear dewatering (HSD) steps commenced.

TABLE 4

| Product | Ash (%) | Moisture (%) | Recovery (%) |
|---|---|---|---|
| H.S. Dewatering | — | 1.0 | — |
| Centrifugation | — | 18.2 | 95.3 |
| Agglomeration | 8.6 | 52.2 | 90.0 |
| Feed | 36.7 | — | 100.0 |

During the centrifugal dewatering step, the water droplets were reduced in size but still filled the void spaces in between the coal particles. The tiny droplets of entrapped water were then separated from the coal particles by the high-shear agitation in air. The tiny water droplets exited the system and/or evaporated quickly without applying heat due to the high curvature and/or the large surface area-to-volume ratio of the water droplets.

Example 5

The Cardinal coal sample was treated with 200 lb/ton of pentane in the same manner as described in Examples 2 and 3. The clean coal product was dewatered by means of a vacuum filter rather than a centrifuge as in Example 4. The filter cake was then fed to a squirrel-cage fan to further reduce the moisture to 1.7%, as shown in Table 5. The ash content of the product coal was relatively high due to the entrainment of mineral matter. In a continuous process, this problem can be readily addressed by installing an appropriate agitator or implementing a two-step process.

TABLE 5

| Product | Ash (%) | Moisture (%) | Recovery (%) |
|---|---|---|---|
| Clean Coal | 12.1 | 1.7 | 87.2 |
| Reject | 86.6 | — | 12.8 |
| Feed | 49.3 | — | 100.00 |

Example 6

The fine coal sample from the Cardinal plant was subjected to two stages of agglomeration using a total of 360 lb/ton of pentane. The clean coal product was dewatered using a vacuum filter, and the filter cake dried using a squirrel-cage fan in one test and an air jet in another to obtain 1.4 and 2.1% moistures, respectively. Both of these devices were designed to provide high-shear agitation in air to dislodge the small droplets of water from the fine coal particles that had been dried by the displacement mechanism depicted in FIG. 1. Both of these mechanical devices seemed to be equally efficient in drying fine coal without using an external heat source. The results presented in Table 6 show that the ash contents were substantially lower than obtained in Example 5, which can be attributed to the two stages of cleaning operations employed.

TABLE 6

| | Squirrel Cage Fan | | | Air Jet | | |
|---|---|---|---|---|---|---|
| Product | Recovery (%) | Ash (%) | Moisture (%) | Recovery (%) | Ash (%) | Moisture (%) |
| Clean Coal | 87.4 | 4.7 | 1.4 | 87.7 | 4.3 | 2.1 |
| Reject | 12.6 | 88.4 | — | 12.3 | 88.7 | — |
| Feed | 100.0 | 50.1 | — | 100.0 | 50.1 | — |

Example 7

A coal sample from the Trans Alta fine coal impoundment, West Virginia, was screened at 100 mesh, and the screen underflow assaying 24.9% ash was treated with pentane (20% by weight of coal) to obtain a clean coal product assaying 8.1% ash and 57.1% moisture with 92.4% recovery. The high product moisture was due to the presence of the water globules stabilized by hydrophobic coal particles. The clean coal product was dewatered using a laboratory-scale horizontal basket centrifuge to reduce the moisture to 21.4%. The centrifuge product was then subjected to a high-shear agitation provided by a squirrel-cage fan to obtain 0.9% moisture. The recoveries for the centrifugation and high-shear agitation were not determined.

TABLE 7

| Product | Ash (%) | Moisture (% wt) | Recovery (%) |
|---|---|---|---|
| H.S. Dewatering | — | 0.9 | — |
| Centrifugation | — | 21.4 | — |
| Agglomeration | 8.1 | 57.1 | 92.4 |
| Feed | 24.9 | — | 100.0 |

Example 8

A nominally 100 mesh×0 coal sample assaying 36.8% ash was obtained from the Litwar coal preparation plant, West Virginia. A size analysis of the sample showed that 7.8% of the material was coarser than 150 μm and 80.1% was finer that 44 μm. It was cleaned of its ash-forming mineral matter by froth flotation rather than using the DBD or the selective agglomeration processes described in the foregoing examples. A Denver laboratory flotation machine with a 4-liter stainless steel cell was used. The flotation test was conducted with 3 lb/ton diesel oil as collector and 1.2 lb/ton MIBC as frother at 2.6% solids. The froth product was subjected to another stage of flotation test without using additional reagent to obtain a clean coal product with 4.2% ash and 8.3% solids. The product was vacuum-filtered using 5 lb/ton of sorbitan monooleate as a dewatering aid. The filter cake containing 19.6% moisture was then subjected to a high-shear agitation provided by a squirrel-cage fan to further reduce the moisture to 0.9% by weight.

TABLE 8

| Product | Ash (%) | Moisture (%) | Recovery (%) |
|---|---|---|---|
| H.S. Dewatering | — | 0.9 | — |
| Filtration | — | 19.6 | — |
| Flotation | 4.2 | 91.7 | 95.8 |
| Feed | 36.8 | — | 100.0 |

Example 9

A copper ore sample was ground in a ball mill for 8 to 20 minutes and the mill products were subjected to a series of flotation tests. A composite of the reject materials at 10% solids was dewatered to 15.6% by means of an air pressure filter at 20 psi. The filter cake was then subjected to a high-shear agitation in a squirrel-cage fan to further reduce the moisture to 0.7% as shown in Table 9. In another test, the composite reject material was conditioned with 5 lb/ton

TABLE 9

| | Pressure Filter at 20 psi | | Vacuum Filter at 20 inch Hg | |
|---|---|---|---|---|
| Product | Recovery (%) | Moisture (%) | Recovery* (%) | Moisture (%) |
| H.S. Dewatering | — | 0.7 | — | 0.6 |
| Filtration | 96.0 | 15.6 | 95.8 | 17.5 |
| Feed | 100.0 | — | 100.0 | — |

*weight recovery of a cationic surfactant (Armeen C) at 30% solids and subsequently with 3 lb/ton of sorbitan monooleate before vacuum filtration. The filter cake containing 17.5% moisture was then subjected to the high-shear dewatering process to further reduce the moisture content to 0.6% as shown in Table 9.

Example 10

In this example, a coal sample from the Pinnacle fine coal impoundment, Wyoming County, W. Va., was tested for the DBD process. The coal sample was a cyclone overflow from a pond recovery plant containing mostly −44 μm materials, which assayed 38% ash by weight. In the plant, the ultrafine coal was not being processed due the difficulties in both recovery and dewatering. In this example, a volume of the coal slurry was added to a kitchen blender and diluted to approximately 3% solids with tap water. The amount of coal in the mixer was approximately 20 g. After adding 20 ml of pentane to the mixer, the slurry was agitated at a

TABLE 10

| Product | Ash (%) | Moisture (% wt) | Recovery (%) |
|---|---|---|---|
| Clean Coal | 3.57 | 4.28 | 7.27 |
| Reject | 81.97 | — | 12.73 |
| Feed | 37.93 | — | 100.00 |

high speed for 45 seconds and then agitated for another 5 minutes at a low speed. During this time, coal particles agglomerated by the hydrophobic liquid, while mineral matter remained dispersed in the aqueous phase. The slurry was then poured over a 30-mesh screen to remove the dispersed mineral matter as underflow. Most of the +30 mesh material, except the largest of the water droplets stabilized by coal particles, was transferred to a stack of screens consisting of 50 and 70 mesh screens. The +50 and −70 mesh fractions assayed 9.8 and 3.2% moistures, respectively. Table 10 shows the composite results of the test, showing that the product moisture and coal recovery can be controlled using size-size separation devices such as screens.

Example 11

The coal sample used in this example was the same as in Example 10. A volume (1 liter) of coal slurry containing approximately 40 g of coal was added to a kitchen blender (mixer). After adding 0.5 liter of pentane to the mixer, the mixture was agitated at a low r.p.m. The agitated slurry was slowly transferred to a 1-inch diameter phase separator, which was made of a ¾-inch diameter glass column with a 9-inch height. At the base of the column, an ultrasonic probe was installed to provide a mechanical energy to dislodge the coal particles from the surfaces of the water drops, which tended to congregate at the phase boundary between water and oil due to gravity. The column was also equipped with an overflow launder at the top to collect the clean coal product semi-continuously. With the application of the ultrasonic energy, it was possible to dislodge the coal particles from the water droplets and allow them to be more fully dispersed in the oil phase. Water was then introduced to the base of the settling column to flood the organic phase into the launder, while the aqueous phase was removed from the bottom. The collected coal and ash products were weighed and analyzed for ash and moisture to obtain

TABLE 11

| Product | Ash (%) | Moisture (%) | Recovery (%) |
|---|---|---|---|
| Clean Coal | 3.9 | 0.54 | 94.3 |
| Reject | 87.9 | — | 5.7 |
| Feed | 31.2 | — | 100.0 |

the results shown in Table 11. As shown, the instant invention produced 94.3% recovery of combustible materials, with the product coal assaying 3.9% ash and 0.54% moisture.

What is claimed is:

1. A system for removing mineral matter from and dewatering fine coal comprised of particles of 1.0 mm in diameter and smaller wherein said fine coal includes mineral impurities, comprising:

a mixer for mixing a hydrophobic liquid with fine coal in an aqueous media, said mixer being configured to permit said mineral impurities to separate from said fine coal into said aqueous media, permitting said hydrophobic liquid to displace water from surfaces of said fine coal, and producing a mixture;

a phase separator for phase separating said mixture produced in said mixing step in which said hydrophobic liquid is atop said aqueous media, said phase separating step producing a first phase containing said hydrophobic liquid, fine coal, and entrained water, and a second phase containing said aqueous media and mineral impurities:

a mechanical separator for separating said entrained water from said fine coal and said hydrophobic liquid from said first phase by a mechanical process, wherein residual mineral impurities are dispersed in the entrained water droplets; and a hydrophobic liquid recovery system for separating hydrophobic liquid from said fine coal to produce a fine coal product with reduced mineral impurities and moisture content.

2. The system of claim 1 wherein said phase separator is a settler.

3. The system of claim 1 wherein said mechanical separator is a size-size separator.

4. The system of claim 3 wherein said size-size separator includes a screen.

5. The system of claim 3 wherein said mechanical separator is a solid-liquid separator.

6. The system of claim 5 wherein said solid-liquid separator includes a filter.

7. The system of claim 5 wherein said solid-liquid separator includes a centrifuge.

8. The system of claim 1 wherein said hydrophobic liquid recovery system includes components configured to recover residual hydrophobic liquid adhering to the surface of said fine coal product.

9. The system of claim 1 further comprising a high shear dewatering apparatus.

10. The system of claim 9 wherein said high shear dewatering apparatus is selected from the group consisting of dynamic mixer, static mixer, rotating fan, fluidized bed, vibrating screen, and air jet.

11. The system of claim 1 further comprising a dry particle collector.

* * * * *